US009117566B2

(12) United States Patent
McCleary et al.

(10) Patent No.: US 9,117,566 B2
(45) Date of Patent: Aug. 25, 2015

(54) IMPEDANCE CONTROLLED SUBSEA ETHERNET OIL FILLED HOSE

(71) Applicant: Teledyne Instruments, Inc., Thousand Oaks, CA (US)

(72) Inventors: Alan D. McCleary, St. Augustine, FL (US); John Bradley Croom, Basking Ridge, NJ (US); Huijiang Xi, Maitland, FL (US); Michael C. Greene, Palm Bay, FL (US)

(73) Assignee: Teledyne Instruments, Inc., Thousand Oaks, CA (US)

( * ) Notice: Subject to any disclaimer, the term of this patent is extended or adjusted under 35 U.S.C. 154(b) by 233 days.

(21) Appl. No.: 13/829,853

(22) Filed: Mar. 14, 2013

(65) Prior Publication Data

US 2014/0262413 A1 Sep. 18, 2014

(51) Int. Cl.

| | |
|---|---|
| ***H01B 7/14*** | (2006.01) |
| ***H01B 13/06*** | (2006.01) |
| ***H01B 11/00*** | (2006.01) |
| ***H01B 7/285*** | (2006.01) |
| ***H01B 11/12*** | (2006.01) |

(52) U.S. Cl.
CPC ..... *H01B 7/14* (2013.01); *H01B 7/285* (2013.01); *H01B 11/12* (2013.01); *Y10T 29/49174* (2015.01)

(58) Field of Classification Search
CPC ..... H01B 7/14; H01B 11/00; H01B 13/06; H01B 7/285; H01B 11/12
USPC ..... 174/47, 113 R, 110 R; 29/857
See application file for complete search history.

(56) References Cited

U.S. PATENT DOCUMENTS

| | | | | |
|---|---|---|---|---|
| 3,790,694 | A | 2/1974 | Portinari | |
| 3,993,860 | A * | 11/1976 | Snow et al. | 174/69 |
| 4,178,577 | A | 12/1979 | Cini et al. | |
| 5,362,925 | A * | 11/1994 | Yamaguchi et al. | 174/120 R |

(Continued)

FOREIGN PATENT DOCUMENTS

| | | |
|---|---|---|
| EP | 2278666 A1 | 1/2011 |
| GB | 1399350 | 7/1975 |

(Continued)

OTHER PUBLICATIONS

International Search Report and Written Opinion for related International Patent Application No. PCT/US2014/015237, mailed May 27, 2014, in 8 pages.

*Primary Examiner* — Timothy Thompson
*Assistant Examiner* — Charles Pizzuto
(74) *Attorney, Agent, or Firm* — Procopio Cory Hargreaves & Savitch LLP

(57) ABSTRACT

One or more insulated conductive wire assemblies are incorporated in a pressure balanced, oil-filled (PBOF) hose. Each conductive wire assembly has a pair of conductive wires each having an insulation layer, an insulating material surrounding the insulated wires, and an outer insulating layer surrounding the insulating material. The insulating material may be selected to have a dielectric constant substantially matching the dielectric constant of the oil in the PBOF hose, so that the insulated pair of conductors perform in the same way both before and after the assembly is submerged in oil in the jumper hose. One or more parameters of the conductive wire assembly are selected such that the assembly has a predetermined impedance when submerged in oil within the PBOF hose.

27 Claims, 2 Drawing Sheets

(56) References Cited

U.S. PATENT DOCUMENTS

| | | | | |
|---|---|---|---|---|
| 5,461,195 | A | 10/1995 | Freeman et al. | |
| 5,565,218 | A * | 10/1996 | Brown et al. | 425/113 |
| 6,222,130 | B1 | 4/2001 | Gareis et al. | |
| 6,787,697 | B2 | 9/2004 | Stipes et al. | |
| 7,195,509 | B2 * | 3/2007 | Hong et al. | 439/352 |
| 7,253,217 | B2 | 8/2007 | Sohal | |
| 7,339,116 | B2 | 3/2008 | Gareis et al. | |
| 7,663,061 | B2 | 2/2010 | Gareis et al. | |
| 7,816,427 | B2 | 10/2010 | Sohal | |
| 7,977,575 | B2 | 7/2011 | Gareis et al. | |
| 2005/0211453 | A1 | 9/2005 | Arzate et al. | |
| 2006/0214024 | A1 * | 9/2006 | Kolacz et al. | 239/289 |
| 2010/0108349 | A1 * | 5/2010 | Baeck et al. | 174/95 |
| 2011/0120745 | A1 * | 5/2011 | Booth et al. | 174/113 R |
| 2014/0027150 | A1 * | 1/2014 | Gundel | 174/102 R |

FOREIGN PATENT DOCUMENTS

| | | |
|---|---|---|
| GB | 1535840 | 12/1978 |
| WO | 88/08440 A1 | 11/1988 |
| WO | 96/36054 | 11/1996 |

* cited by examiner

IMPEDANCE CONTROLLED SUBSEA ETHERNET OIL FILLED HOSE

BACKGROUND

1. Field of the Invention

The present invention relates to communications interlink devices for connection of equipment used in subsea operations, such as equipment used in the subsea oil and gas industry, and to insulated conductive wire assemblies incorporated in such interlinks. Such interlinks may be in the form of pressure balanced oil-filled (PBOF) hose, or undersea cables containing electrical or fiber-optic conductors.

2. Related Art

Subsea communication systems or interlink devices generally employ electrical Ethernet through electrical telecommunications twisted pair cable, or are purely optical fiber communication systems that may be included in PBOF hose or as a special submarine cable. Purely electrical systems have some limitations in the subsea environment. Standard electrical input/output interconnects and electrical cables can only step out to a distance of around 50 meters. Per industry specifications, a land based 10/100BaseT Ethernet cable has a maximum transmission distance of 100 meters at standard atmospheric pressure, after which the signal performance may be unacceptable Subsea PBOF hose interlinks or cables commonly contain silicone oil or other fluid to provide pressure compensation. Standard terrestrial Ethernet cable is adversely affected by submergence in oil, which causes a reduction in impedance, increased back reflection, reduced transmission power and the distance that a signal can be sent along the cable without increasing power. The longer the cable becomes, the more of a problem this becomes. The maximum transmission distance for subsea PBOF hose Ethernet interlink using terrestrial CAT cable is about 70 meters, so such interlinks are normally limited to 70 meters in length.

SUMMARY

An impedance controlled subsea Ethernet PBOF hose and method of making an impedance controlled subsea Ethernet PBOF hose which allows signal transmission over longer distances is provided. In one aspect, an insulated conductive wire assembly for transmitting electrical signals is provided for incorporation in a pressure balanced, oil filled hose. In one embodiment, the insulated conductive wire assembly is constructed to have a predetermined impedance which is unchanged or substantially unchanged before and after submerging the assembly in oil, and comprises a pair of conductive wires, each wire having an insulation layer, an insulating material surrounding the insulated wires, and an outer insulating layer surrounding the insulating material. The insulating material in one embodiment is selected to have a dielectric constant substantially matching the dielectric constant of the oil in the jumper cable or PBOF hose in which the conductive wire assembly is to be installed, so that the insulated pair of conductors perform in the same way outside the cable as if they were submerged directly in oil. This allows parameters of the conductive wire assembly to be controlled prior to installation in the oil-filled jumper cable or hose, in order to achieve a predetermined impedance which remains at least substantially unchanged when the assembly is installed in the hose.

The insulating material surrounding the conductive wires may be a mobile medium such as a dielectric gel having a dielectric constant substantially matching the dielectric constant of the oil in the hose in which the assembly is installed, and in one embodiment the mobile medium is a suitable water blocking gel. The conductive wires are of larger gauge than those used in typical Ethernet cables. The thickness of the insulation layers surrounding the wires is adjusted in order to provide the desired, predetermined impedance, and in one embodiment the impedance may be around 100 ohms.

According to another aspect, a subsea Ethernet interlink comprises an outer hose containing pressure compensating oil having a first dielectric constant, and at least a first insulated electrical conductor assembly submerged in the oil and extending along the length of the cable, the first insulated electrical conductor assembly having a predetermined impedance and comprising a pair of conductive wires, an insulation layer covering each wire, an outer insulation layer surrounding the insulated conductive wires to leave a space between the outer insulation layer and wire covering insulation layers, and an insulation material having a dielectric constant substantially matching the first dielectric constant surrounding the insulated conductors and filling the space between the outer insulation layer and the wire covering insulation layers. The predetermined impedance is selected to reduce or eliminate impedance drop off due to submerging an insulated conductor in oil and thus improve Ethernet communication. In one embodiment, the predetermined impedance is around 100 ohms, per IEEE standard 802.3 for electrical Ethernet communication.

In one embodiment, the pair of insulated wires in the insulated conductor assembly are in a twisted pair configuration, but other configurations may be used in alternative embodiments. One, two or more insulated wire devices or assemblies each having a pair of insulated wires enclosed in gel inside an outer insulation layer may extend within the oil filled hose, depending on the number of circuits to be connected by the cable.

The PBOF hose has end fittings at each end such as an underwater mateable plug or receptacle connector units for releasable mating engagement with matching receptacle or plug units of underwater equipment, a hose termination, or the like. Underwater connectors such as Nautilus wet mateable electrical connectors manufactured by Teledyne ODI of Daytona Beach, Fla., or other wet mateable connectors may be provided at one or both ends of the hose.

By matching the impedance of the insulated conductor assembly to the desired impedance of the oil filled cable for Ethernet communication purposes, and by surrounding the insulated conductors with a gel having a dielectric constant substantially matching that of the pressure compensating oil in which the conductor assembly is installed, any change in impedance due to submerging the conductor assembly in the oil is reduced and the length over which a signal can be sent is increased. The desired or predetermined impedance of the conductor assembly can be achieved by suitable selection of the parameters of the various elements of the assembly, such as dielectric constants of the insulation layers, the diameter of the conductive wires, and the thickness of the insulation layers. For example, increasing the insulation thickness increases overall impedance, while increasing the dielectric constant of one or more components of the insulated wire assembly decreases impedance. In one embodiment, the thickness of the wire surrounding each conductive wire was varied until the desired impedance was achieved, while leaving other parameters of the assembly unchanged.

Other features and advantages of the present invention should be apparent from the following description which illustrates, by way of example, aspects of the invention.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a pressure balanced, oil filled (PBOF) subsea Ethernet hose or jumper which can transmit electrical signals over greater lengths underwater. One or more electrical conductor assemblies extending inside the oil-filled cable with the conductor devices have a predetermined impedance which is controlled by varying one or more selected parameters of the devices to improve Ethernet communication when submerged in the oil-filled cable.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 1:
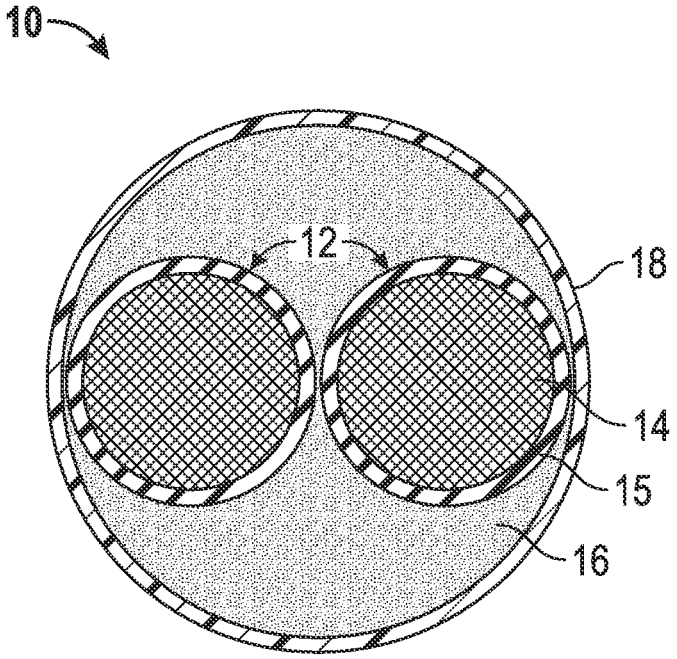
FIG. 1 is a cross-sectional view of one embodiment of an insulated conductor assembly for installation in a pressure balanced, oil-filled subsea Ethernet hose or jumper.
Figure 2:
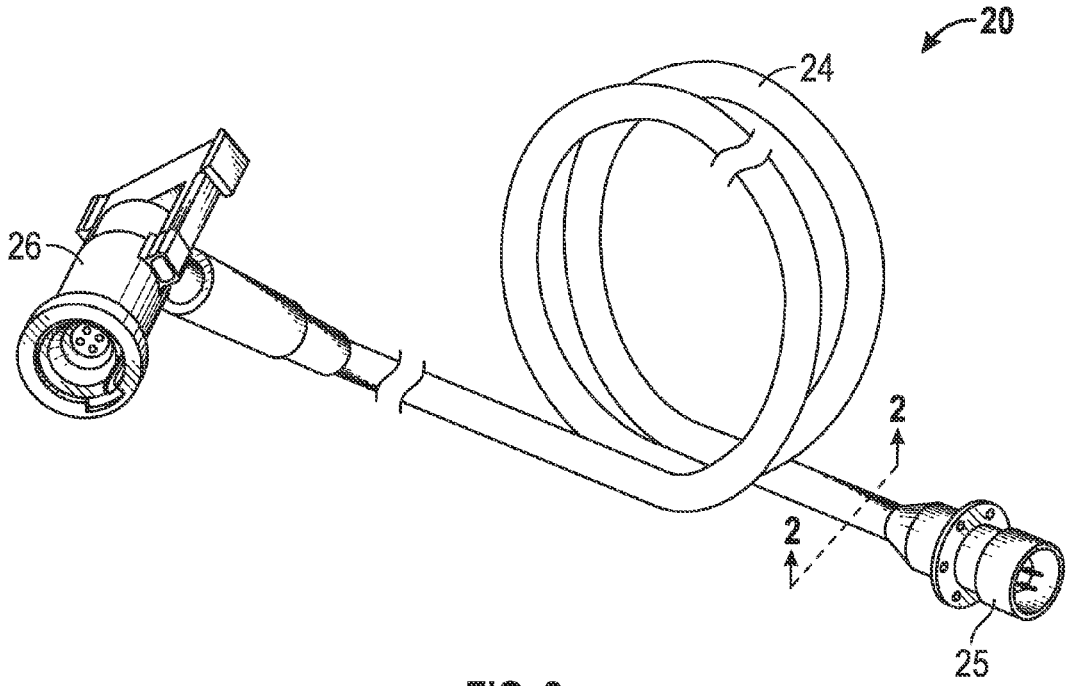
FIG. 2 is a perspective view of a subsea Ethernet pressure balanced oil-filled hose incorporating one or more of the insulated conductor assemblies of FIG. 1.
Figure 3:
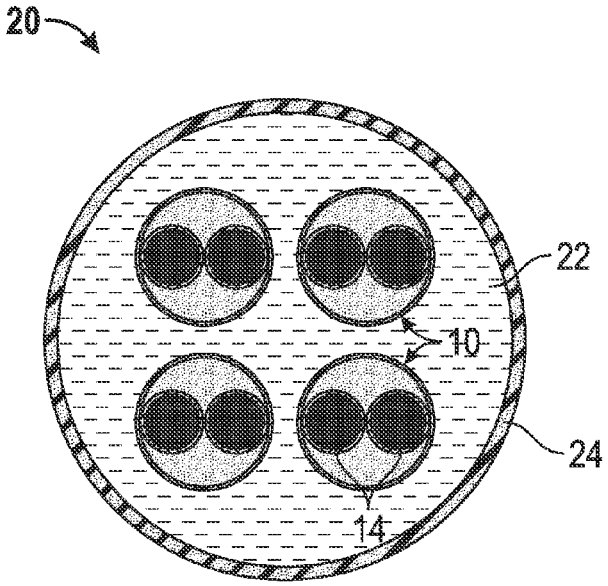
FIG. 3 is a cross-sectional view on the lines 3-3 of FIG. 2 of one embodiment of the subsea Ethernet pressure balanced oil-filled hose incorporating four of the insulated conductor assemblies of FIG. 1.

FIG. 1 illustrates one embodiment of an insulated conductor assembly 10 for submerging in oil in a subsea Ethernet hose or jumper 20 as illustrated in FIGS. 2 and 3. The insulated conductor assembly in one embodiment comprises a pair of insulated conductors 12 each comprising a conductive wire 14 and an insulation layer 15 surrounding each wire. An insulating material 16 coats and surrounds the insulated wires 12, and an outer insulating layer 18 surrounds the insulating material. The insulating material is selected to have a dielectric constant substantially matching the dielectric constant of the oil in the jumper or hose 20 in which the conductive wire assembly is to be installed, so that the insulated pair of conductors perform in the same way as if they were submerged directly in oil. This allows parameters of the conductive wire assembly to be controlled in order to achieve a predetermined impedance level which remains at least substantially unchanged when the assembly is installed in the PBOF hose, as described in more detail below.

In one embodiment, the insulating material surrounding the conductive wires is a mobile substance or medium such as a dielectric gel having a dielectric constant substantially matching the dielectric constant of the oil in the hose in which the assembly is installed, and a suitable water blocking gel may be used. For example, where the oil filling the hose is silicone oil, the gel may be a silicone based gel, such as Dow Corning 111 Valve Lubricant and Sealant manufactured by Dow Corning of Elizabethtown, Ky., or other similar gels. Matching the dielectric constant of the insulating material surrounding the insulated conductors to the dielectric constant of the oil in the hose means that the impedance of the assembly prior to installation in a silicone oil filled hose is the same or at least substantially the same as if the insulated conductors were submerged directly in silicone oil. Other impedance controlling parameters of the assembly can therefore be selected by testing of impedance level outside the hose and varying one or more parameters in order to achieve the desired overall impedance.

The insulating gel 16 coats the wire insulating layers 15 of the twisted pair of conductors and acts to control impedance of the conductors from one end of the hose assembly to the other. The outer insulation layer 18 may be any suitable insulating material such as Mylar® tape or other electrically insulating polyester tape, which is wound around the gel coated conductors to hold the gel around the insulated wires 12.

In one embodiment, the pair of insulated wires in the insulated conductor assembly are in a twisted pair configuration as known in the field, but other configurations may be used in alternative embodiments. One, two or more insulated conductor assemblies each having a pair of insulated wires enclosed in gel inside an outer insulation layer may be provided within the oil filled hose, depending on the number of circuits to be connected by the hose.

FIGS. 1 and 2 illustrate one embodiment of an Ethernet hose or jumper 20 which comprises an outer flexible tube or hose 24 containing pressure compensating oil 22 and four insulated conductor assemblies 10 extending between opposite ends of the hose. A greater number or lesser number of insulated conductor assemblies may be installed in the oil filled hose in alternative embodiments, depending on the total number of electrical circuits or signals to be transmitted. Standard end fittings 25, 26 are connected at each end of the hose and include contacts which communicate with the conductors in conductor assemblies 10. Each end fitting may be an underwater mateable plug or receptacle connector unit for releasable mating engagement with matching receptacle or plug unit on underwater equipment, or other end fittings such as a hose termination or the like may be provided at one end. End fittings of different types may be provided in different hose assemblies depending how the hose is to be used. In the illustrated embodiment, end fittings 25, 26 are underwater plug and socket connectors such as Nautilus wet mateable electrical connectors manufactured by Teledyne ODI of Daytona Beach, Fla. Contacts in the end fittings are suitably coupled to opposite ends of the wires extending through insulated conductor assemblies 10. It will be understood that other end fittings suitable for subsea use may be connected at opposite ends of the hose assembly in other embodiments, depending on its intended installation.

As best illustrated in FIG. 3, hose 24 contains four insulated conductor assemblies 10 which are submerged in the pressure compensating oil 22 filling the hose and extend between opposite ends of the hose for connection to the end fittings to provide electrical signal communication between equipment connected to the respective end fittings.

Each insulated conductor assembly has a predetermined impedance selected so as to reduce back reflection of signals transmitted along the conductors. There are several factors or parameters which control impedance of assembly 10 when submerged in an oil such as silicone oil in a PBOF hose. As discussed above, the gel material 16 surrounding the insulated wires in one embodiment is selected to have a dielectric constant close or identical to the dielectric constant of oil 22, so that the twisted conductor pair performs in the gel outside the hose similarly to how it would perform in oil. This allows one or more parameters of the assembly which affect impedance to be adjusted prior to assembly in the PBOF hose so as to provide the desired or predetermined impedance Z, providing for more convenient manufacture of the oil-filled hose. The impedance of each insulated conductor assembly 10 is controlled such that, when the conductor devices 10 are combined with the surrounding oil 22 in the PBOF hose assembly 20, an acceptable impedance is achieved. In one embodiment, the predetermined impedance is around 100 ohms, as is appropriate for Ethernet communication per IEEE standard 802.3.

The impedance of the assembly 10 is dependent on wire diameter d, insulation thickness t, and dielectric constants of the insulation layers of the assembly. Thus, the impedance can be adjusted by varying one or more of these parameters. The following equation approximates the relationship between these parameters for a twisted pair configuration, although there are various other ways to define Z:

$$Z = \frac{120}{\sqrt{\varepsilon}} a\cosh\frac{d+2t}{d}$$

where d=diameter of wire 14, or wire gauge.

t=insulation thickness (i.e. total thickness of the wire insulation layer 15, gel 16, and outer insulation layer 18).

$\in$=Dielectric constant of the entire assembly, using the relationship:

$1/\in_{total}=(1/\in_a)+(1/\in_b)+(1/\in_c)\ldots$, where $\in_a$, $\in_b$, etc. are the dielectric constants of individual insulating components of the assembly.

The wire diameter, insulation thickness, and dielectric constants of the insulating layers are selected so that the impedance Z is at or close to the desired or predetermined impedance value for optimum Ethernet communication, nominally around 100 ohms. In general, increase in insulation thickness increases impedance and increases in dielectric constant decrease impedance. Increase in conductor diameter also affects impedance but the effect is variable since variation in the wire diameter or gauge also affects separation of the insulated wires 12. Typically there is not a wide range of choice of impedance values for an acceptable pressure compensating oil 22 or gel 16. In practice, parameters of the pressure compensating oil 22 cannot be varied significantly in view of hose diameter considerations as well as the fact that there is not a wide range of choice for the oil 22. In one embodiment, oil 22 was silicone oil and the insulating gel 16 was a silicone based gel as described above, having a dielectric constant matching or substantially matching that of the oil. In one embodiment, the overall impedance of the assembly was primarily controlled by varying the thickness of insulating layer 15 while keeping other parameters unchanged until the insulated wire yielded an acceptable impedance when combined with the gel and oil. Other parameters of assembly 10 may be controlled to adjust impedance to the desired level in other embodiments.

In one embodiment of an insulated conductor assembly 10 having a predetermined impedance of around 100 ohms, the wire gauge was selected to be larger than in conventional twisted pair conductors, in order to improve manufacturability and durability. Wires 14 in one embodiment were 20 AWG (American Wire Gauge) wires, but wires in the range from 18 to 22 AWG may be used in other embodiments. Wires 14 may be of copper or other conductive material such as silver plated copper in order to reduce resistive losses. Insulation layers 15 may be of any suitable insulating material, and these layers in one embodiment were of Polytetrafluoroethylene (PTFE). Testing was carried out with wires having different insulation thicknesses in order to select an insulated wire that yielded an acceptable impedance when combined with the gel and surrounding oil in the configuration of FIG. 1. Wire insulation layer 15 may have a thickness in the range from 0.005 to 0.025 inches and the thickness of layer 15 was around 0.015 inches in one specific example. Other insulation thicknesses may be used in alternative embodiments to achieve the desired overall impedance level, depending on the wire diameter and dielectric constants of the materials used in the assembly.

In the foregoing embodiments, the conductor gauge, insulation thickness, and gel dielectric constant of an insulated conductor assembly are chosen so as to achieve the desired impedance when submerged in oil in an Ethernet hose in order to improve Ethernet communication. By controlling the impedance to be at or close to the acceptable impedance for Ethernet communication in an Ethernet hose (nominally at or close to 100 ohms), the effective signal transmission distance in a subsea Ethernet hose can be increased. Currently, the longest subsea Ethernet hoses have a transmission distance limited to 70 meters. A subsea Ethernet hose as described above in connection with the embodiment of FIGS. 1 to 3 may achieve signal transmission distances of up to 100 meters.

The above embodiments allow better control of the adverse drop in impedance of paired insulated conductors when immersed in oil, to allow longer subsea Ethernet jumpers to be used. Surrounding the insulated conductors with a gel encapsulated within an outer insulating layer allows impedance to be controlled more readily to acceptable levels while also providing better pressure compensation. In an alternative embodiment, the predetermined impedance of each insulated conductor assembly may be controlled such that the desired or predetermined impedance of around 100 ohms is achieved only when the assembly is submerged in oil in the hose, but this is a less desirable for manufacturing purposes, since the final impedance is unknown prior to assembly in the hose. In the embodiments described above, the predetermined impedance of the insulated conductor assembly outside the hose is the same as the desired impedance when assembled in the hose, since the impedance is at least substantially unchanged when the assembly is submerged in oil in the hose, due to the matching of the dielectric constant of the gel to the dielectric constant of the pressure compensating oil in the hose.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. An insulated conductive wire assembly for incorporation in a pressure balanced, oil-filled hose, comprising:

a pair of conductive wires, each wire having an insulation layer surrounding the conductive wire;

an insulating material surrounding the insulated wires; and an outer insulating layer surrounding the insulating material;

the assembly having a predetermined impedance Z;

wherein the predetermined impedance Z is at least substantially unchanged when the assembly is submerged in a pressure balanced, oil filled jumper hose.

2. The assembly of claim 1, wherein the insulating material has a dielectric constant substantially matching the dielectric constant of a selected pressure compensating oil used in oil-filled jumper hoses.

3. The assembly of claim 2, wherein the insulating material is a mobile substance.

4. The assembly of claim 2, wherein the insulating material is a gel.

5. The assembly of claim 4, wherein the gel is a silicone based gel material having a dielectric constant substantially the same as the dielectric constant of silicone oil.

6. The assembly of claim 1, wherein the conductive wires have a diameter the range from 18 to 22 AWG (American Wire Gauge).

7. The assembly of claim 6, wherein the thickness of the insulation layer surrounding each wire is in the range from 0.005 to 0.025 inches.

8. The assembly of claim 1, wherein at least one of the following assembly parameters is selected to provide the predetermined impedance Z: thickness of the wire insulating layers; thickness of the outer insulating layer, thickness of the mobile insulating material, and dielectric constants of one or more insulating layers.

9. The assembly of claim 8, wherein each wire insulating layer is of Polytetrafluoroethylene (PTFE) and has a thickness in the range from 0.005 to 0.025 inches.

10. The assembly of claim 9, wherein each conductive wire has a diameter range from 18 to 22 AWG (American Wire Gauge).

11. The assembly of claim 1, wherein the outer insulating layer comprises a tape of insulating material wound around the mobile insulating material to hold the mobile insulating material around the insulated conductive wires.

12. The assembly of claim 11, wherein the tape is an electrically insulating polyester tape.

13. The assembly of claim 1, wherein the predetermined impedance Z is around 100 ohms.

14. The assembly of claim 1, wherein the pair of insulated conductive wires are in a twisted pair configuration.

15. A subsea Ethernet jumper hose, comprising:

an outer hose containing pressure compensating oil having a first dielectric constant; and at least one insulated electrical conductor assembly having a predetermined impedance Z and comprising a pair of conductive wires, each wire having an insulation layer surrounding the conductive wire, an insulating material surrounding the insulated wires, and an outer insulating layer surrounding and containing the insulating material;

wherein the insulated electrical conductor assembly is submerged in the oil in the outer hose and extends along the length of the hose; and the predetermined impedance Z of the insulated electrical conductor assembly is at least substantially unchanged when submerged in the pressure compensating oil in the outer hose.

16. The hose of claim 15, wherein the insulating material has a dielectric constant substantially matching the dielectric constant of the pressure compensating oil.

17. The hose of claim 16, wherein the predetermined impedance is around 100 ohms both in air and when submerged in the pressure compensating oil in the hose.

18. The hose of claim 15, wherein the at least one insulated electrical conductor assembly comprises two or more identical insulated electrical conductor assemblies submerged in the oil and extending side by side along the length of the hose.

19. The hose of claim 15, wherein the pair of insulated wires in the insulated conductor assembly are in a twisted pair configuration.

20. The hose of claim 15, further comprising an end fitting secured at each end of the hose having contacts in electrical communication with the conductive wires, the end fittings comprising underwater mateable connector units.

21. The hose of claim 16 wherein the insulating material comprises a mobile insulating material.

22. The hose of claim 16 wherein the insulating material surrounding the insulated condutive wires is a water blocking gel.

23. The hose of claim 22 wherein the pressure compensating oil is silicone oil and the water blocking gel is a silicone based gel.

24. The hose of claim 15, wherein the conductive wires have a diameter the range from 18 to 22 AWG (American Wire Gauge).

25. The hose of claim 24 wherein the thickness of the insulation layer surrounding each wire is in the range from 0.005 to 0.025 inches.

26. The hose of claim 21, wherein the outer insulating layer of said at least one insulated electrical conductor assembly comprises a tape of insulating material wound around the mobile insulating material to hold the mobile insulating material around the insulated conductive wires.

27. A method of making an impedance controlled subsea Ethernet hose, comprising:

forming at least one insulated conductor assembly by surrounding a pair of conductive wires each having an insulating layer extending over the conductive wire with an insulating gel material having a first dielectric constant, and wrapping an outer insulating layer of insulating material around the insulating gel material to hold the gel material around the insulated conductive wires;

the conductive wire diameter, wire insulating layer material and thickness, and outer insulating layer material and thickness being selected such that the insulated conductor assembly has a predetermined impedance Z;

filling a flexible hose of insulating material with pressure compensating oil, whereby the flexible hose comprises a pressure balanced, oil-filled jumper hose;

submerging at least one insulated conductor assembly in the pressure compensating oil such that the insulated conductor assembly extends along the length of the oil-filled jumper hose;

the pressure compensating oil having a dielectric constant which is at least substantially equal to the first dielectric constant, wherein the predetermined impedance Z is at least substantially unchanged when the insulated conductor assembly is submerged in the pressure balanced, oil-filled jumper hose; and attaching opposite ends of the pressure balanced, oil-filled jumper hose to first and second underwater connector units having contacts in electrical communication with opposite ends of the conductive wires.

* * * * *